US008958584B2

(12) United States Patent
Kim et al.

(10) Patent No.: US 8,958,584 B2
(45) Date of Patent: Feb. 17, 2015

(54) APPARATUS, METHOD, AND MEDIUM FOR REMOVING CROSSTALK

(75) Inventors: Young-tae Kim, Yongin-si (KR); Sang-wook Kim, Yongin-si (KR); Jung-ho Kim, Yongin-si (KR); Sang-chul Ko, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1982 days.

(21) Appl. No.: 11/704,269

(22) Filed: Feb. 9, 2007

(65) Prior Publication Data

US 2007/0269061 A1 Nov. 22, 2007

(30) Foreign Application Priority Data

May 19, 2006 (KR) ..... 10-2006-0045342

(51) Int. Cl.
*H04R 5/02* (2006.01)
*H04S 7/00* (2006.01)

(52) U.S. Cl.
CPC ..... *H04S 7/303* (2013.01); *H04S 2420/01* (2013.01)
USPC ..... 381/309; 381/17; 381/18; 381/1; 381/26

(58) Field of Classification Search
CPC ..... H04S 1/002; H04S 1/005; H04S 3/00; H04S 3/02; H04S 5/00; H04S 7/302; H04S 7/305; H04S 2400/01; H04S 2420/01; H04R 5/027; H04R 5/033; H04R 5/04
USPC ..... 381/1–2, 10–13, 17, 300–311, 26, 381/98–103, 18–20, 74
See application file for complete search history.

(56) References Cited

U.S. PATENT DOCUMENTS 5,715,317 A 2/1998 Nakazawa
6,243,476 B1 * 6/2001 Gardner ..... 381/303

FOREIGN PATENT DOCUMENTS

JP 8-265900 10/1996
JP 2003-92799 3/2003

OTHER PUBLICATIONS

Author: Aimee Lalime Title "Development of Computationally Efficient Binaural Stimulation for the Analysis of Structural Acoustic Data" Source: Thesis submitted to the faculty of Virginia Polytechnic Institute and State University 2002.*
Author:Nishino et al Title:Interpolating HRTF for Auditory Virtual Reality Institution:Nagoya University.*

* cited by examiner

*Primary Examiner* — Xu Mei
(74) *Attorney, Agent, or Firm* — Staas & Halsey LLP

(57) ABSTRACT

An apparatus, method, and medium of removing crosstalk are provided. The apparatus for removing crosstalk in each of audio signals of a plurality of channels, includes: a position recognition unit recognizing the position of a listener; a calculation unit calculating a crosstalk removal function with respect to the recognized position; and a filtering unit removing the crosstalk by using the calculated result.

13 Claims, 10 Drawing Sheets

APPARATUS, METHOD, AND MEDIUM FOR REMOVING CROSSTALK

CROSS-REFERENCE TO RELATED APPLICATIONS

This application claims the benefit of Korean Patent Application No. 10-2006-0045342, filed on May 19, 2006, in the Korean Intellectual Property Office, the disclosure of which is incorporated herein in its entirety by reference.

BACKGROUND OF THE INVENTION

1. Field of the Invention

The present invention relates to removal of crosstalk, and more particularly, to an apparatus, method, and medium of removing crosstalk from each audio signal of a plurality of channels.

2. Description of the Related Art

A listener listening to audio signals of a plurality of channels can experience best stereo sound effect when he/she is positioned at a predefined optimum listening region. Here, the optimum listening region is an area where the listener cannot perceive crosstalk from the audio signals and the crosstalk is a phenomenon that the audio signals of the plurality of channels are mixed together when the signals are output from speakers and transferred to the two ears of the listener.

FIG. 1A is a diagram illustrating a case where a listener 110 is positioned in an optimum listening region 150, and FIG. 1B is a diagram illustrating a case where the listener 110 is not in the optimum listening region 150. Here, reference number 140 does not refer to an actual sound source. Instead, reference numeral 140 refers to a virtual object that the listener perceives as a sound source, that is, a virtual sound source. The position of this virtual sound source 140 should be considered when the optimum listening region 150 is determined.

Referring to FIGS. 1A and 1B, it is assumed that the listener 110 perceives the virtual sound source 140 as positioned at the middle point between a left speaker 120 and a right speaker 130. In this case, if the listener 110 is positioned in the optimum listening region 150 as illustrated in FIG. 1A, the listener 110 perceives the virtual sound source 140 as positioned at the middle point between the left speaker 120 and the right speaker 140. However, if the listener 110 is not in the optimum listening region 150, as illustrated in FIG. 1B, the listener 110 perceives the virtual sound source 140 as positioned closer to the left speaker 120.

Accordingly, the listener 110, who is not in the optimum listening region, still experiences crosstalk effect. Thus, conventional crosstalk removing apparatuses are not adaptively responding to the motion of the listener 110.

SUMMARY OF THE INVENTION

Additional aspects, features, and/or advantages of the invention will be set forth in part in the description which follows and, in part, will be apparent from the description, or may be learned by practice of the invention.

The present invention provides an apparatus for removing crosstalk in which a filter for removing crosstalk from each audio signal of a plurality of channels is updated adaptively to the motion of a listener.

The present invention also provides a method of removing crosstalk by which a filter for removing crosstalk from each audio signal of a plurality of channels is updated adaptively to the motion of a listener.

The present invention also provides a computer readable recording medium having embodied thereon a computer program for executing a method of removing crosstalk by which a filter for removing crosstalk from each audio signal of a plurality of channels is updated adaptively to the motion of a listener.

According to an aspect of the present invention, there is provided an apparatus for removing crosstalk in each of audio signals of a plurality of channels, the apparatus including: a position recognition unit recognizing the position of a listener; a calculation unit calculating a crosstalk removal function with respect to the recognized position; and a filtering unit removing the crosstalk by using the calculated result.

According to another aspect of the present invention, there is provided a method of removing crosstalk in each of audio signals of a plurality of channels, the method including: recognizing the position of a listener; obtaining a crosstalk removal function with respect to the recognized position; and removing the crosstalk by using the calculated result.

According to another aspect of the present invention, there is provided a computer readable recording medium having embodied thereon a computer program for executing a method of removing crosstalk in each of audio signals of a plurality of channels, wherein the method includes: recognizing the position of a listener; obtaining a crosstalk removal function with respect to the recognized position; and removing the crosstalk by using the calculated result.

According to another aspect of the present invention, there is provided a method of removing crosstalk in audio signals of a plurality of channels, the method including recognizing the position of a listener with respect to an optimum listening region; obtaining a crosstalk removal function from a storage unit with respect to the recognized position if the listener is outside of the optimum listening region; and removing the crosstalk in the audio signals by using the obtained crosstalk removal function.

According to another aspect of the present invention, there is provided at least one computer readable medium storing computer readable instructions to implement methods of the present invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF THE PREFERRED EMBODIMENTS

Figure 1A:
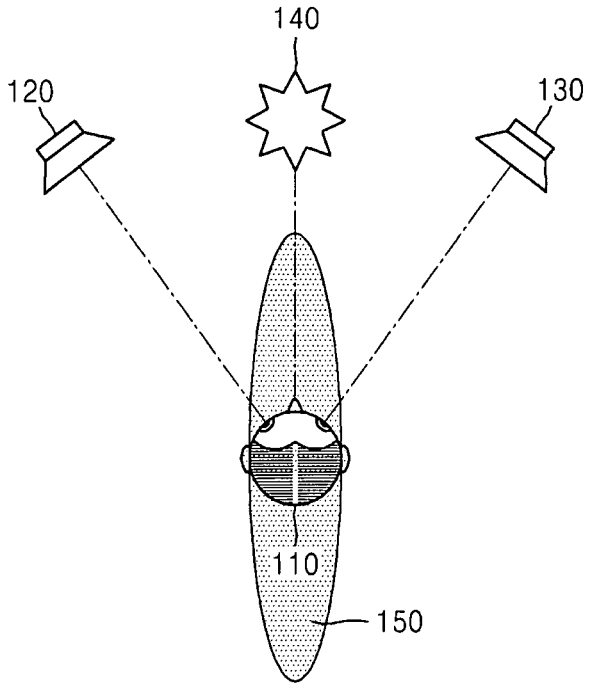
FIG. 1A (RELATED ART)
FIG. 1A is a diagram illustrating a case where a listener is positioned in an optimum listening region.
Figure 1B:
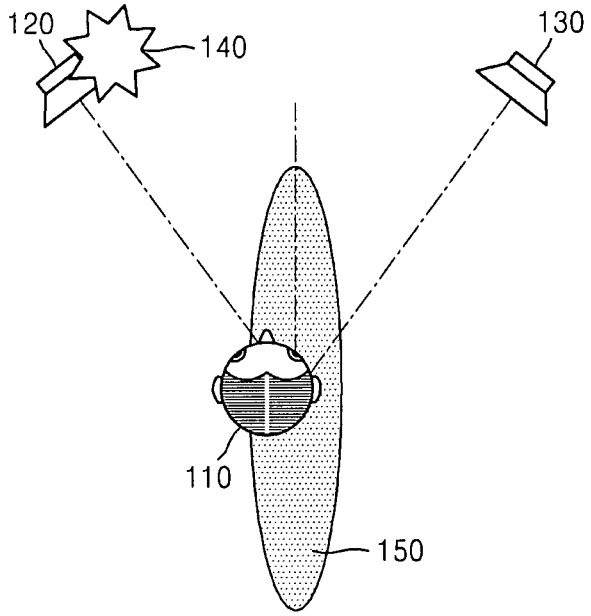
FIG. 1B (RELATED ART)
FIG. 1B is a diagram illustrating a case where a listener is not in an optimum listening region.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

Figure 2:
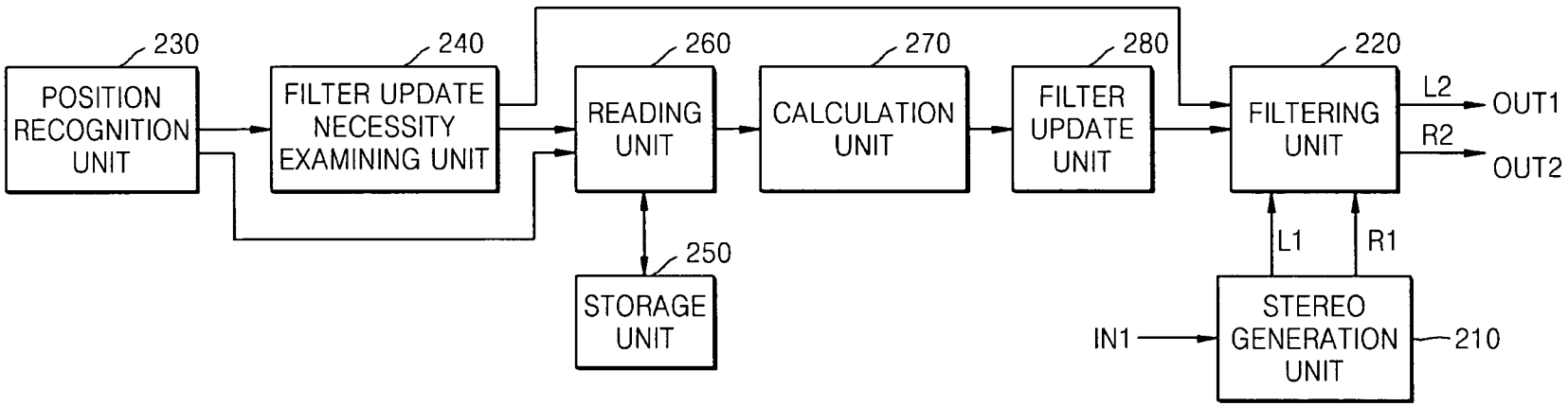
FIG. 2 is a block diagram illustrating an apparatus for removing crosstalk according to an exemplary embodiment of the present invention.

FIG. 2 is a block diagram illustrating an apparatus for removing crosstalk according to an exemplary embodiment of the present invention. The apparatus for removing crosstalk is composed of a stereo generation unit (stereo generator) 210, a filtering unit (filter) 220, a position recognition unit (position recognizer) 230, a filter update necessity examining unit (filter update necessity examiner) 240, a storage unit 250, a reading unit ( reader) 260, a calculation unit (calculator) 270, and a filter update unit (filter updater) 280.

The stereo generation unit 210 generates stereo audio signals (L1, R1) by using a mono audio signal input through input terminal IN 1.

The filtering unit 220 removes crosstalk from the audio signals (L1, R1) generated in the stereo generation unit 210 and outputs the crosstalk-free audio signals (L2, R2) through output terminals OUT1 and OUT2, respectively. Output terminals OUT1 and OUT2 may be connected to two speakers, respectively. The phrase "removing of crosstalk" denotes processing a plurality of audio signals (for example, L1 and R1), so that crosstalk does not occur in a plurality of audio signals (for example, L2 and R2) to be output through a plurality of speakers. FIG. 2 is a block diagram illustrating an apparatus for removing crosstalk for convenience of explanation and it is assumed that the plurality of channels are two channels.

The filtering unit 220 has a filter which is used to remove crosstalk. This filter may be a digital filter. The transfer function of the filter disposed in the filtering unit 220 will be referred to as a crosstalk removal function (crosstalk removal operation). An optimum listening region is determined according to this crosstalk removal function and the crosstalk removal function is determined according to a head related transfer function, which will be explained later.

In the present application, the optimum listening region may indicate a region where a listener can experience a stereo effect when listening to audio signals provided through a plurality of channels. In this case, if the listener moves out of the optimum listening region, the listener may feel that an audible click occurs in the audio signals.

The position recognition unit 230 recognizes the position of the listener. More specifically, the position recognition unit 230 recognizes at which position the head of the listener is. For this, the position recognition unit 230 may take a picture of the listener by using an image pickup apparatus (not shown), such as a camera, and obtain information on the position of the listener in the taken image. Here, the obtained position information is 2-dimensional (2D) information. Also, the position recognition unit 230 may obtain information on the distance between the image pickup apparatus and the listener. In this way, the position recognition unit 230 can three-dimensionally recognize the position of the listener. An apparatus for tracking the position of the head disclosed in Korean Patent Application No. 10-2006-0028027, which corresponds to U.S. patent application Ser. No. 11/646,472 filed Dec. 28, 2006 which has the title "Method and Apparatus for Tracking Listener's Head Position for Virtual Stereo Acoustics", can be an example of the position recognition unit 230.

The filter update necessity examining unit 240 examines whether or not updating of the filter disposed in the filtering unit 220 is needed. More specifically, the filter update necessity examining unit 240 examines whether or not updating of the crosstalk removal is needed.

For this, the filter update necessity examining unit 240 examines whether or not the position recognized by the position recognition unit 230 is a predetermined position. More specifically, the filter update necessity examining unit 240 may examine whether or not the position recognized by the position recognition unit exists in an optimum listening region. Also, the filter update necessity examining unit 240 may examine whether or not the position recognized by the position recognition unit 230 exists in a filter maintaining region set in the optimum listening region.

The storage unit 250 stores a head related transfer function or a crosstalk removal function with respect to each of one or more positions. Here, the respective positions indicate the positions of the head. Here, the positions of the left ear and right ear relative to the center or the head may be modeled in advance. That is, the relations between the position of the center of the head and the positions of the left ear and the right ear may be fixed.

The head related transfer function, the crosstalk removal function, and the storage unit 250 will now be explained in more detail.

According to a first exemplary embodiment of the present invention, the storage unit 250 stores a head related transfer function (HRTF) with respect to each of one or more positions. In the present application, the head related transfer function is a function expressing the relations between a plurality of audio signals (x1, x2) output through a plurality of speaker and a plurality of audio signal (y1, y2) arriving at the two ears of the listener, as equation 1 below:

$$\begin{bmatrix} y_1 \\ y_2 \end{bmatrix} = \begin{bmatrix} H_{11} & H_{21} \\ H_{12} & H_{22} \end{bmatrix} \begin{bmatrix} x_1 \\ x_2 \end{bmatrix} \tag{1}$$

Here, x1 is an audio signal to be output through the left speaker, x2 is an audio signal to be output through the right speaker, y1 is an audio signal arriving at the left ear, and y2 is an audio signal arriving at the right ear.

Also, $H_{11}$ is a head related transfer function indicating the relation between the audio signal (x1) to be output through the left speaker and the audio signal (y1) arriving at the left ear, $H_{11}$ is a head related transfer function indicating the relation between the audio signal (x1) to be output through the left speaker and the audio signal (y2) arriving at the right ear, $H_{21}$ is a head related transfer function indicating the relation between the audio signal (x2) to be output through the right speaker and the audio signal (y1) arriving at the left ear, and $H_{22}$ is a head related transfer function indicating the relation between the audio signal (x2) to be output through the right speaker and the audio signal (y2) arriving at the right ear.

The head related transfer function (HRTF) is a function of a position (p) and a frequency (f). In addition, a head related impulse response (HRIR) is a function of a position (p) and a time (t). Specifically, the HRTF is the result of Fourier transforming of the HRIR. In this manner, the HRTF is slightly different from the HRIR. However, for convenience of explanation, hereinafter it is assumed that the HRTF can indicate the HRIR. Herein, the position (p) may be expressed three-dimensionally.

According to a second exemplary embodiment of the present invention, the storage unit 250 stores a crosstalk removal function with respect to each of one or more positions. From equation 1, the crosstalk removal function is expressed as an inverse function of the head related transfer function as equation 2 below:

$$G = H^{-1} = \frac{1}{(H_{11}H_{22} - H_{12}H_{21})}\begin{bmatrix} H_{22} & -H_{21} \\ -H_{12} & H_{11} \end{bmatrix} = \begin{bmatrix} G_{11} & G_{12} \\ G_{21} & G_{22} \end{bmatrix} \quad (2)$$

The reading unit 260 may operate in response to the result examined in the filter update necessity examining unit 240. More specifically, if the examination result indicates that the recognized position is not in the optimum listening region, the reading unit 260 can operate. Also, if the result indicates that the recognized position is not in the filter maintaining region, the reading unit 260 may operate.

More specific operations of this reading unit 260 will now be explained.

According to the first exemplary embodiment of the present invention, the reading unit 260 reads a head related transfer function corresponding to the position recognized in the position recognition unit 230, from the storage unit 250. If the head related transfer function corresponding to the recognized position exists in the storage unit 250, the reading unit 260 reads the head related transfer function corresponding to the recognized position. However, if the head related transfer function corresponding to the recognized position does not exist in the storage unit 260, the reading unit 260 can read a head related transfer function with respect to each of a plurality of positions on a straight line on which the recognized position is located.

According to the second exemplary embodiment of the present invention, the reading unit 260 reads a crosstalk removal function corresponding to the position recognized in the position recognition unit 230, from the storage unit 250. If the crosstalk removal function corresponding to the recognized position exists in the storage unit 250, the reading unit 260 reads the crosstalk removal function corresponding to the recognized position. However, if the crosstalk removal function corresponding to the recognized position does not exist in the storage unit 260, the reading unit 260 can read a crosstalk removal function with respect to each of a plurality of positions on a straight line on which the recognized position is located. In the present invention, "the crosstalk removal function corresponding to the recognized position" denotes a crosstalk removal function which makes the recognized position a predetermined position in the optimum listening region, for example, the center of the optimum listening region.

An operation of the calculation unit 270 according to the first exemplary embodiment of the present invention will now be explained.

If the reading unit 260 reads the head related transfer function corresponding to the recognized position, the calculation unit 270 calculates the inverse function of the read head related transfer function, and outputs the calculated result as the crosstalk removal function for the recognized position.

If the reading unit 260 reads the head related transfer function related to each of the plurality of positions on the straight line on which the recognized position is located, the calculation unit 270 interpolates a head related transfer function with respect to the recognized position, by using the read head related transfer functions. Then, the calculation unit 270 calculates the inverse function of the interpolated head related transfer function, and outputs the calculated result as the crosstalk removal function for the recognized position.

An operation of the calculation unit 270 according to a second exemplary embodiment of the present invention will now be explained.

If the reading unit 260 reads the crosstalk removal function corresponding to the recognized position, the calculation unit 270 receives the read result as an input and outputs the input read result without change.

If the reading unit 260 reads the crosstalk removal function related to each of the plurality of positions on the straight line on which the recognized position is located, the calculation unit 270 interpolates a crosstalk removal function with respect to the recognized position, by using the read crosstalk removal functions, and outputs the interpolated crosstalk removal function.

The filter update unit 280 updates the crosstalk removal function of the filter with the crosstalk removal function input from the calculation unit 270.

Figure 3:
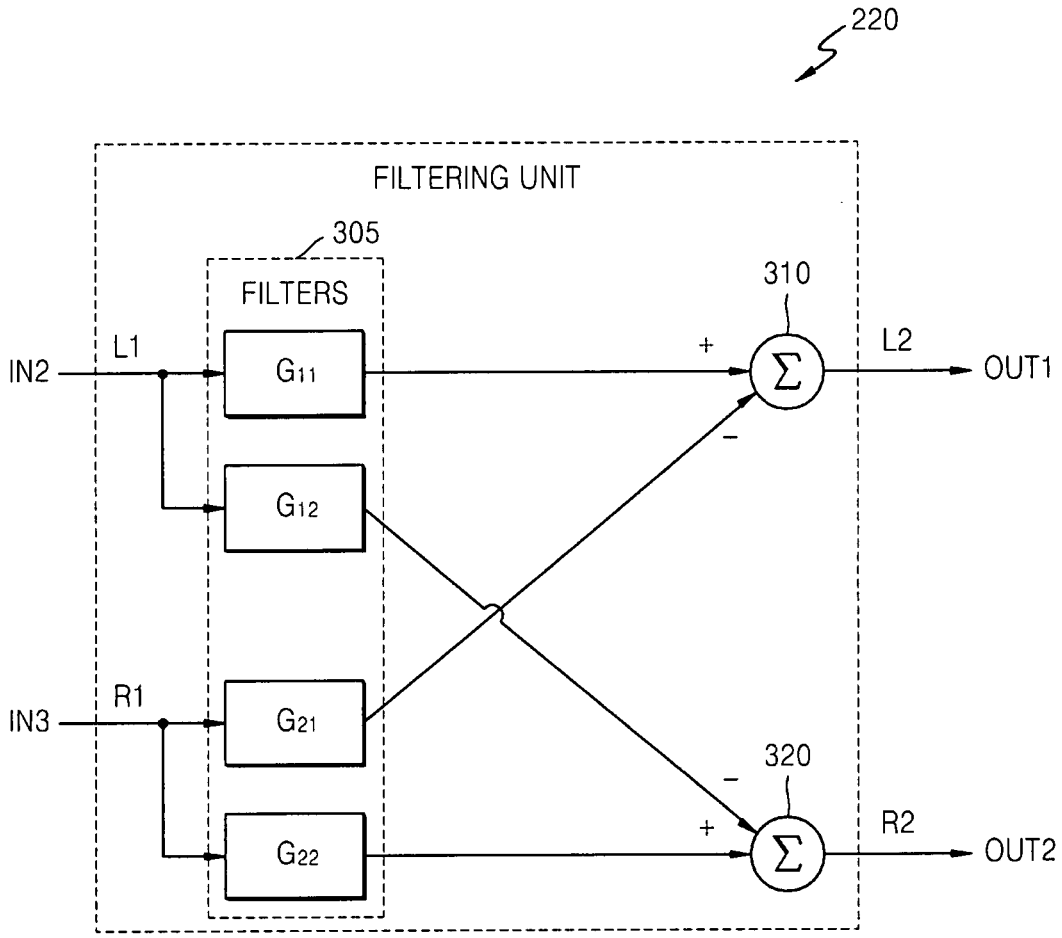
FIG. 3 is a block diagram of a filtering unit illustrated in FIG. 2 according to an exemplary embodiment of the present invention.

FIG. 3 is a block diagram of a filtering unit illustrated in FIG. 2 according to an exemplary embodiment of the present invention. The filtering unit 220 is composed of a plurality of filters 305, a first coupling unit 310 and a second coupling unit 320. Here, input terminals IN 2 and IN 3 are terminals through which the audio signals (L1, R1) generated in the stereo generation unit 210 are input.

The plurality of filters 305 removes crosstalk in audio signal L1, by using crosstalk removal functions $G_{11}$, removes crosstalk in audio signal L1, by using crosstalk removal function $G_{12}$, removes crosstalk in audio signal R1, by using crosstalk removal function $G_{21}$, and removes crosstalk in audio signal R1, by using crosstalk removal function $G_{22}$.

The first coupling unit 310 subtracts the result of the crosstalk removal using crosstalk removal function $G_{21}$, from the result of the crosstalk removal using crosstalk removal function $G_{11}$, and outputs the subtraction result as audio signal L2 through output terminal OUT 1.

The second coupling unit 320 subtracts the result of the crosstalk removal using crosstalk removal function $G_{12}$, from the result of the crosstalk removal using crosstalk removal function $G_{22}$, and outputs the subtraction result as audio signal R2 through output terminal OUT 2.

Figure 4A:
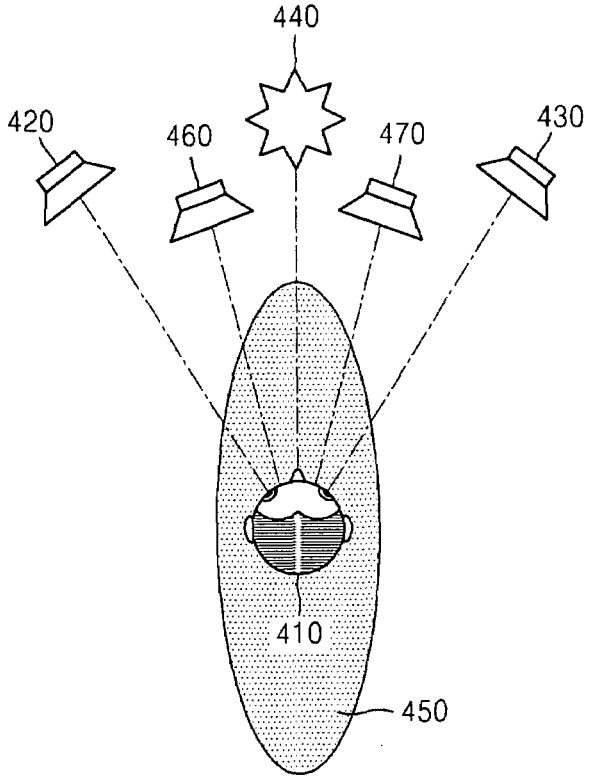
FIGS. 4A and 4B are reference diagrams illustrating operations of a position recognition unit and a filter update necessity examining unit illustrated in FIG. 2 according to an exemplary embodiment of the present invention.
Figure 4B:
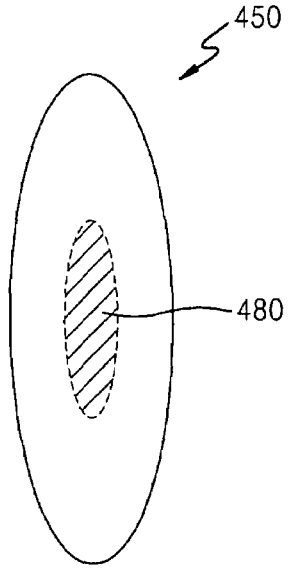

FIGS. 4A and 4B are reference diagrams illustrating operations of the position recognition unit 230 and the filter update necessity examining unit 240 illustrated in FIG. 2 according to an exemplary embodiment of the present invention.

The position recognition unit 230 can take a photo of a listener 410 by using image pickup apparatuses 460 and 470 and obtain information on the position of the listener 410 in the taken image. Also, the position recognition unit 230 can obtain information on the distance between the image pickup apparatuses 460 and 470 and the listener 410.

If the listener 410 is positioned in the optimum listening region 450 as illustrated in FIG. 4A, the listener 410 can recognize a virtual sound source 440 as positioned in the middle point between a left speaker 420 and a right speaker 430.

However, if the listener 410 is not in the optimum listening region 450 unlike as illustrated in FIG. 4A, the listener 410 recognizes the virtual sound source 440 as positioned closer to the left speaker 420 or to the right speaker 430.

Accordingly, if the filter of the filtering unit 220 is adaptively updated with respect to the motion of the listener 410, that is, if the crosstalk removal function is updated adaptively to the motion of the listener 410, however big the radius of the moving of the listener 410 is, the listener 410 can recognize the virtual sound source 410 as positioned in the middle point between the left speaker 420 and the right speaker 430.

For this, whenever the recognized position changes, the filter update necessity examining unit 240 can command an operation of the reading unit 260, or if the recognized position is not in the optimum listening region 450, the filter update necessity examining unit 240 can command an operation of the reading unit 260.

Also, if the recognized position is not in a filter maintaining region 480, the filter update necessity examining unit 240 can command an operation of the reading unit 260. The filter maintaining region 480 is a region set inside the optimum listening region 450 as illustrated in FIG. 4B. In this case, the filter update necessity examining unit 240 may examine whether or not the recognized position exists in the filter maintaining region 480. If the result indicates that the recognized position does not exist in the filter maintaining region 480, the filter update necessity examining unit 240 commands an operation of the reading unit 260.

Figure 5A:
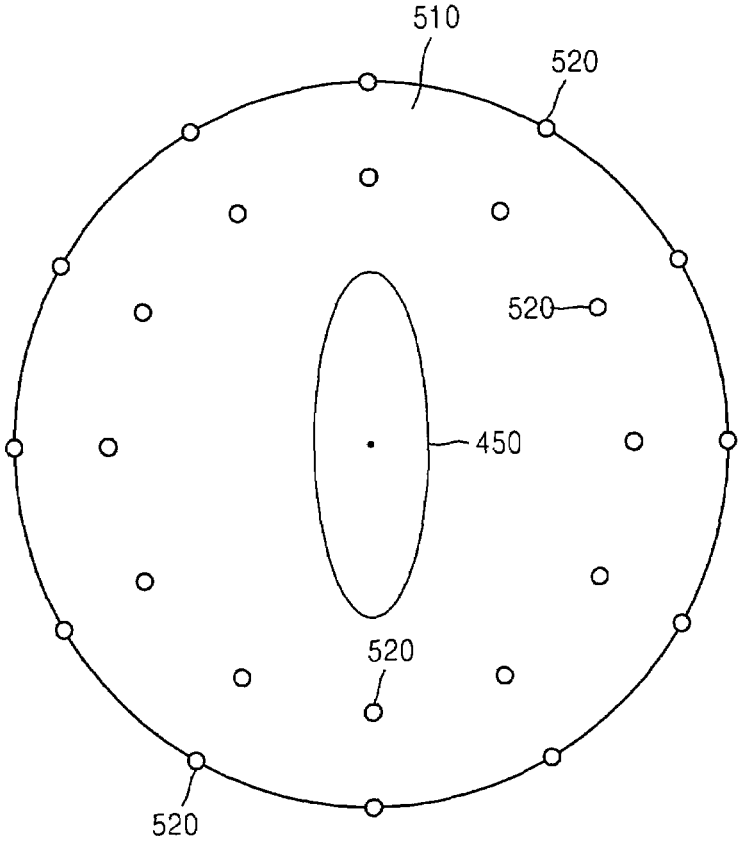
FIGS. 5A and 5B are reference diagrams illustrating operations of a storage unit, a reading unit and a calculation unit illustrated in FIG. 2 according to an exemplary embodiment of the present invention.
Figure 5B:
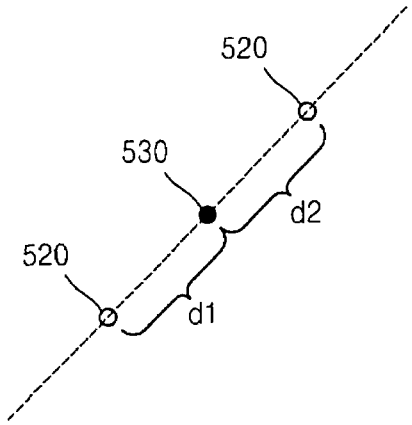

FIGS. 5A and 5B are reference diagrams illustrating operations of the storage unit 250, the reading unit 260, and the calculation unit 270 illustrated in FIG. 2 according to an exemplary embodiment of the present invention. In FIGS. 5A and 5B, reference number 510 indicates an arbitrary region including the optimum listening region 450 and reference number 530 indicates a position recognized by the position recognition unit 230.

According to the first exemplary embodiment of the present invention, the storage unit 250 stores a head related transfer function with respect to each of one or more positions 520. According to another exemplary embodiment of the present invention, the storage unit 250 stores a crosstalk removal function with respect to each of one or more positions 520.

Referring to FIG. 5B, according to the first exemplary embodiment of the present invention, the storage unit 250 does not have a stored head related transfer function corresponding to the recognized position 530, and the reading unit 260 reads a head related transfer function corresponding to each of the two positions 520 on the straight line on which the recognized position 530 is located.

In this case, the calculation unit 270 interpolates a head related transfer function corresponding to the recognized position 530, by using the two read head related transfer functions. If d1 is the same as d2, the calculation unit 270 obtains the mean of the two read head related transfer functions and determines the mean value as the head related transfer function corresponding to the recognized position 530.

Referring again to FIG. 5B, according to the second exemplary embodiment of the present invention, the storage unit 250 does not have a stored head related transfer function corresponding to the recognized position 530, and the reading unit 260 reads a crosstalk removal function corresponding to each of the two positions 520 on the straight line on which the recognized position 530 is located.

In this case, the calculation unit 270 interpolates a head related transfer function corresponding to the recognized position 530, by using the two read crosstalk removal functions. If d1 is the same as d2, the calculation unit 270 obtains the mean of the two read crosstalk removal functions and determines the mean value as the crosstalk removal function corresponding to the recognized position 530.

Figure 6:
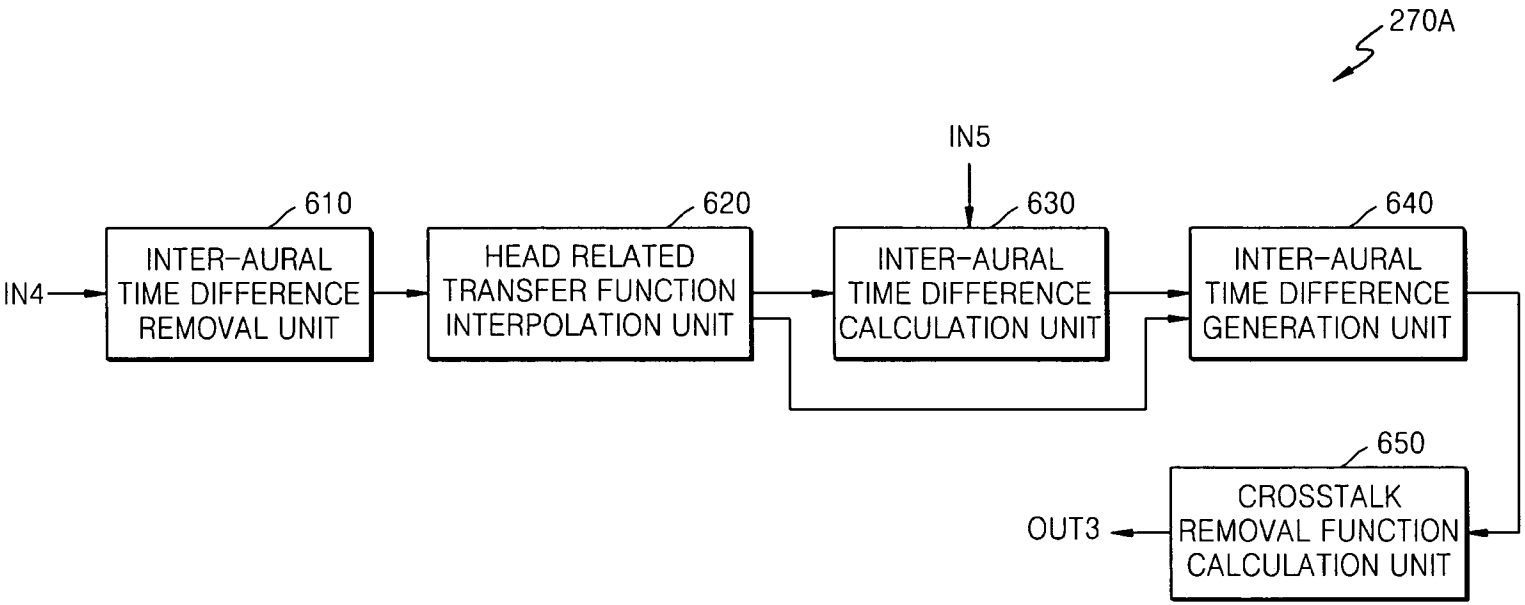
FIG. 6 is a block diagram of a calculation unit illustrated in FIG. 2 according to an exemplary embodiment of the present invention.

FIG. 6 is a block diagram of the calculation unit (calculator) 270 illustrated in FIG. 2 according to the first exemplary embodiment (270A) of the present invention. The calculation unit 270 is composed of an inter-aural time difference removal unit (inter-aural time difference remover) 610, a head related transfer function interpolation unit (head related transfer function interpolator) 620, an inter-aural time difference calculation unit (inter-aural time difference calculator) 630, an inter-aural time difference generation unit (inter-aural time difference generator) 640, and a crosstalk removal function calculation unit (crosstalk removal function calculator) 650.

The inter-aural time difference removal unit 610 removes an inter-aural time difference (ITD) in each of the read head related transfer functions input through input terminal IN 4. Even though sounds come from an identical sound source, the time taken by sound arriving at the left ear may be different from the time taken by sound arriving at the right ear. That is, sounds of the identical sound source may arrive at the left ear and the right ear at different times, respectively. This inter-aural time difference varies with respect to the position of the listener, and the relative position of the listener with respect to the sound source in particular. However, in the present application, for convenience of explanation it is assumed that the position of the sound source is fixed. Accordingly, the head related transfer functions stored in the storage unit are those determined considering the inter-aural time differences. That is, among stored head related transfer functions having an identical position of the head, $H_{11}$, $H_{12}$, $H_{21}$, and $H_{22}$, inter-aural time differences can exist between $H_{11}$, $H_{12}$, and $H_{21}$, $H_{22}$. Inter-aural time differences can exist among all other head related transfer functions stored in the storage unit 250, as between $H_{11}$, $H_{12}$, and $H_{21}$, $H_{22}$. The inter-aural time difference removal unit 610 removes the inter-aural time difference in each of the read head related time transfer functions.

By using the head related transfer functions in which the inter-aural time differences are removed, the head related transfer function interpolation unit 620 interpolates the head related transfer function corresponding to the recognized position. That is, the interpolation performed in the head related transfer function interpolation unit 620 may be interpolation in space domain not in time domain.

The inter-aural time difference calculation unit 630 receives information on the recognized position through input terminal IN 6. Then, the inter-aural time difference unit 630 calculates an inter-aural time difference that can occur at the recognized position. That is, if the head of the listener is positioned at the recognized position, the inter-aural time difference calculation unit 630 calculates an inter-aural time difference that can occur between the left ear and right ear of the listener.

The inter-aural time difference generation unit 640 generates the calculated inter-aural time difference in the interpolated head related transfer function. In this way, the calculated inter-aural time difference can exist between $H_{11}$, $H_{12}$, and $H_{21}$, $H_{22}$ of the interpolated head related transfer function.

The crosstalk removal function calculation unit 650 calculates the inverse function of the generated head related transfer function in which the calculated inter-aural time difference exists, and outputs the calculated inverse function as the crosstalk removal function corresponding to the recognized position, through output terminal OUT 3.

Figure 7:
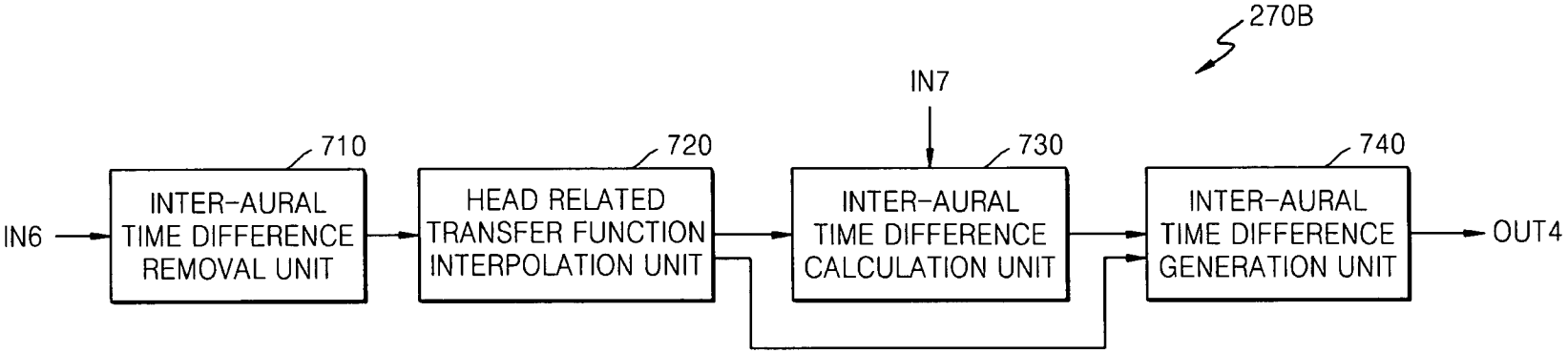
FIG. 7 is a block diagram of the calculation unit illustrated in FIG. 2 according to another exemplary embodiment of the present invention.

FIG. 7 is a block diagram of the calculation unit 270 illustrated in FIG. 2 according to the second exemplary embodiment (270B) of the present invention.

The calculation unit (calculator) 270 is composed of an inter-aural time difference removal unit (inter-aural time difference remover) 710, a crosstalk removal function interpolation unit (crosstalk removal function interpolator) 720, an inter-aural time difference calculation unit (inter-aural time difference calculator) 730, and an inter-aural time difference generation unit (inter-aural time difference generator) 740.

The inter-aural time difference removal unit 710 removes an inter-aural time difference in each of the read crosstalk removal functions input through input terminal IN 5. As the head related transfer functions stored in the storage unit 250 are those determined considering the inter-aural time differences, the crosstalk removal functions stored in the storage unit 250 are those determined considering the inter-aural time differences. That is, among stored crosstalk removal functions having an identical position of the head, $G_{11}$, $G_{12}$, $G_{21}$, and $G_{22}$, inter-aural time differences can exist between $G_{11}$, $G_{12}$, and $G_{21}$, $G_{22}$. Inter-aural time differences can exist among all other head related transfer functions stored in the storage unit 250, as between $G_{11}$, $G_{12}$, and $G_{21}$, $G_{22}$. The inter-aural time difference removal unit 610 removes the inter-aural time difference in each of the read crosstalk removal functions.

By using the crosstalk removal functions in which the inter-aural time differences are removed, the crosstalk removal function interpolation unit 720 interpolates the crosstalk removal function corresponding to the recognized position. That is, the interpolation performed in the crosstalk removal function interpolation unit 620 may be interpolation in space domain not in time domain.

The inter-aural time difference calculation unit 730 receives information on the recognized position through input terminal IN 7. Then, the inter-aural time difference unit 730 calculates an inter-aural time difference that can occur at the recognized position. That is, if the head of the listener is positioned at the recognized position, the inter-aural time difference calculation unit 730 calculates an inter-aural time difference that can occur between the left ear and right ear of the listener.

The inter-aural time difference generation unit 740 generates the calculated inter-aural time difference in the interpolated crosstalk removal function. In this way, the calculated inter-aural time difference can exist between $G_{11}$, $G_{12}$, and $G_{21}$, $G_{22}$ of the interpolated crosstalk removal function. Also, the inter-aural time difference generation unit 740 generates the calculated inter-aural time difference in the interpolated crosstalk removal function and outputs the generated result as the crosstalk removal function corresponding to the recognized position through output terminal OUT 4.

Figure 8:
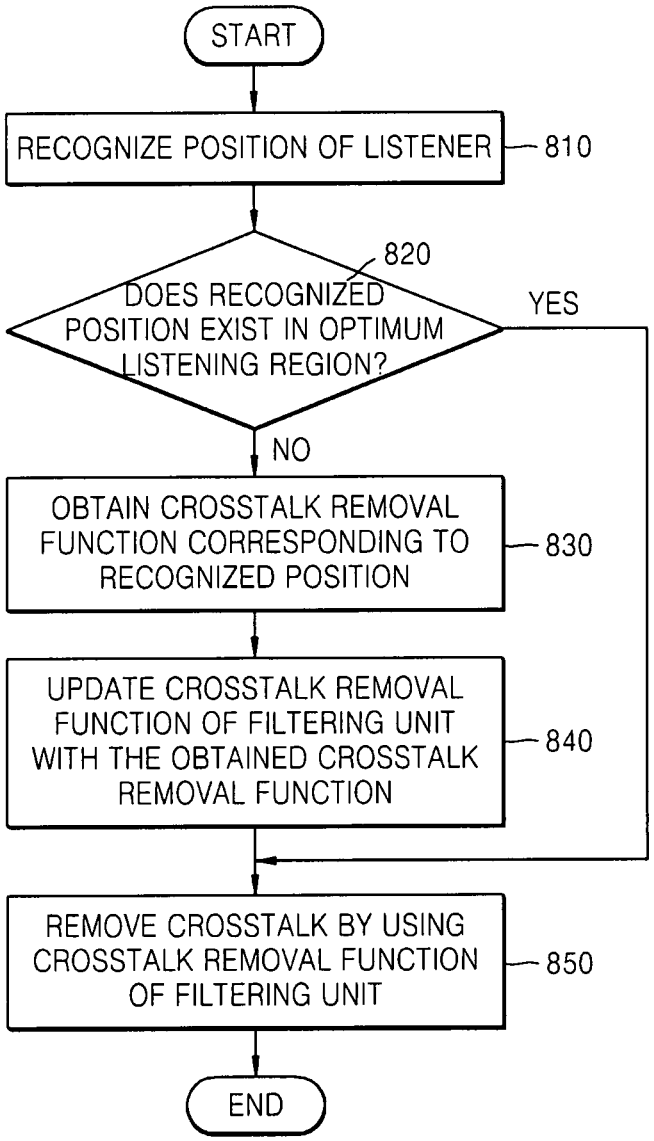
FIG. 8 is a flowchart illustrating a method of removing crosstalk according to an exemplary embodiment of the present invention.

FIG. 8 is a flowchart illustrating a method of removing crosstalk according to an exemplary embodiment of the present invention, including operations 810 through 850 for updating filters for removing crosstalk in each of audio signals of a plurality of channels, adaptively to the motion of a listener.

The position recognition unit 230 recognizes the position of the listener in operation 810.

The filter update necessity examining unit 240 determines whether or not the position recognized in operation 810 exists in an optimum listening region in operation 820. As illustrated in FIG. 8, in operation 810, it may be determined whether or not the position recognized in operation 810 exists in an optimum listening region. Also, unlike as illustrated in FIG. 8, in operation 810, it may be determined whether or not the position recognized in operation 810 exists in a filter maintaining region.

If it is determined in operation 810 that the position does not exist in the optimum listening region, the calculation unit 270 obtains a crosstalk removal function with respect to the position recognized in operation 810, in operation 830.

The filter update unit 280 updates the crosstalk removal function of the filter with the crosstalk removal function obtained in operation 830, in operation 840.

After operation 840, or if it is determined in operation 820 that the position exists in the optimum listening region, the filtering unit 220 removes crosstalk in each of the audio signal of the plurality of channels, by using the crosstalk removal function of the filter in operation 850.

Figure 9:
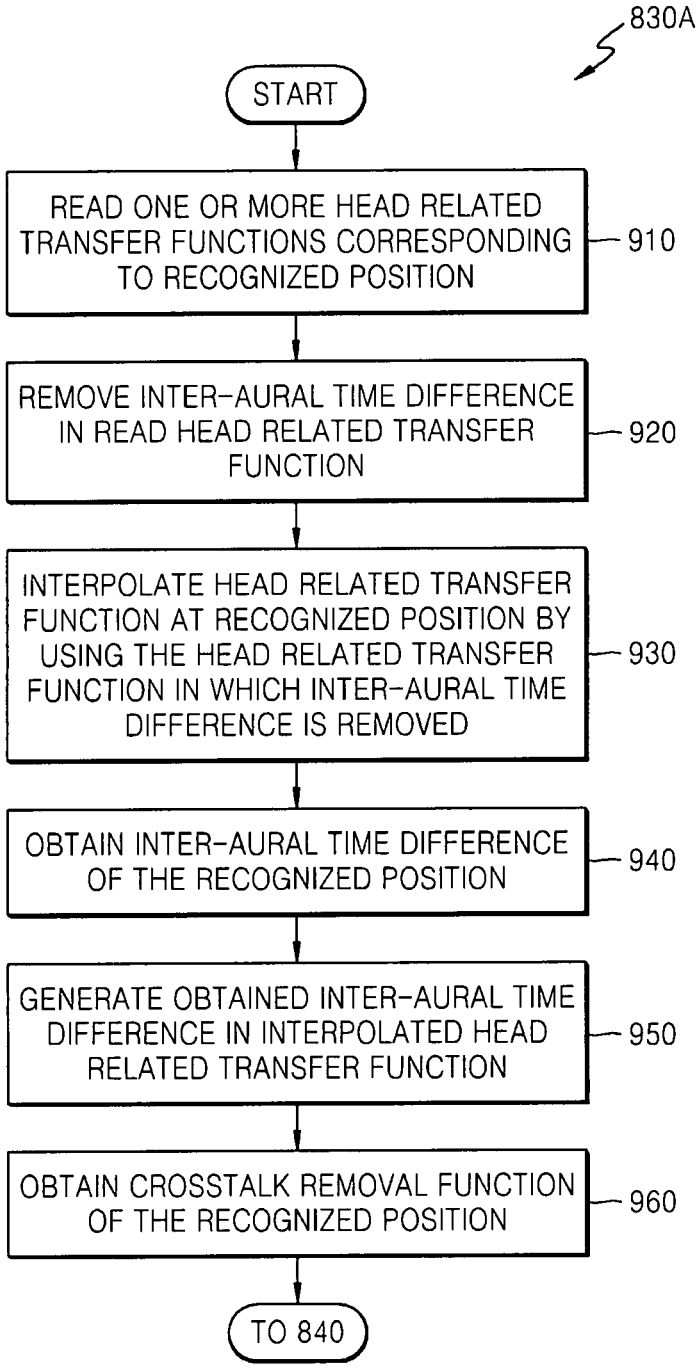
FIG. 9 is a flowchart of operation 830 illustrated in FIG. 8 according to an exemplary embodiment of the present invention.

FIG. 9 is a flowchart of operation 830 illustrated in FIG. 8 according to the first exemplary embodiment (830A) of the present invention, including operations 910 through 960 for obtaining a crosstalk removal function with respect to the position recognized in operation 810.

The reading unit 260 reads one or more head related transfer functions corresponding to the position recognized in operation 810, from the storage unit 250 in operation 910.

The inter-aural time difference removal unit 610 removes the inter-aural time difference in each of the head related transfer functions read in operation 910, in operation 920 and the head related transfer function interpolation unit 620 interpolates a head related transfer function corresponding to the position recognized in operation 810, by using the head related transfer functions, in which the inter-aural time differences are removed in operation 810, in operation 930.

The inter-aural time difference calculation unit 630 obtains an inter-aural time difference that can occur at the position recognized in operation 810, in operation 940. The inter-aural time difference generation unit 640 generates the obtained inter-aural time difference in the head related transfer function interpolated in operation 930, in operation 950.

The crosstalk removal function calculation unit 650 obtains the inverse function of the head related transfer function generated in operation 950, and determines the obtained inverse function as the crosstalk removal function with respect to the position recognized in operation 810, in operation 960 and then, operation 840 is performed.

Figure 10:
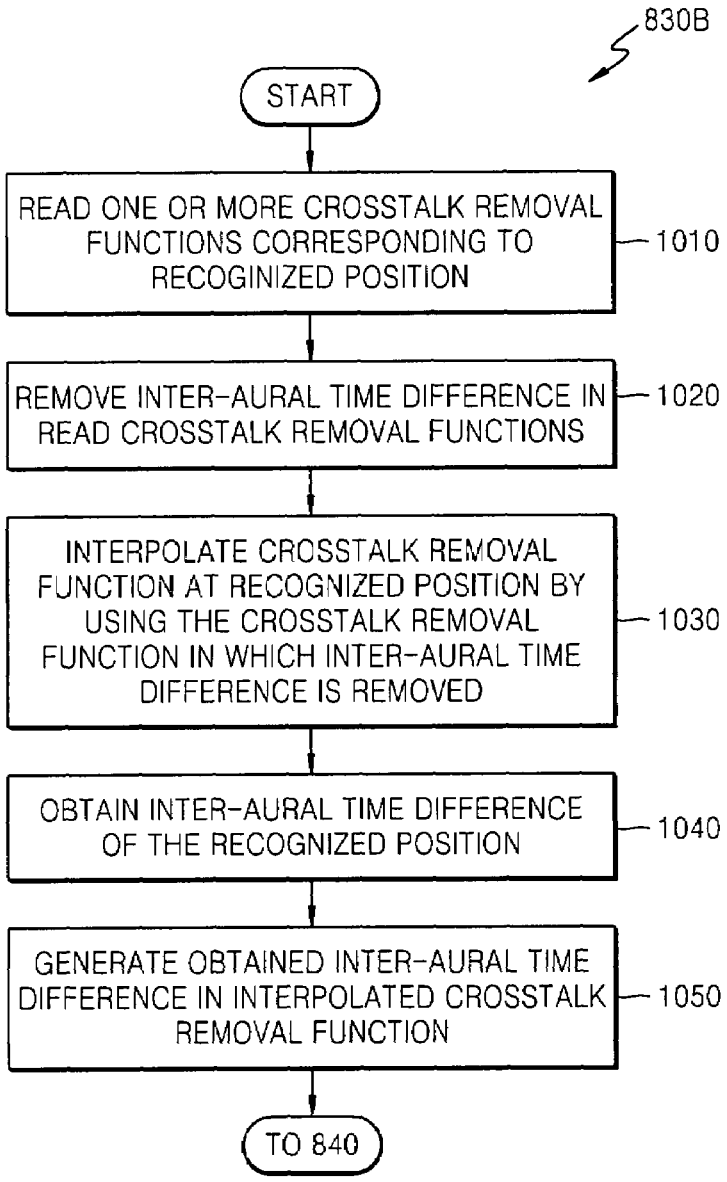
FIG. 10 is a flowchart of operation 830 illustrate in FIG. 8 according to another exemplary embodiment of the present invention.

FIG. 10 is a flowchart of operation 830 illustrate in FIG. 8 according to the second exemplary embodiment (830*b*) of the present invention, including operations 1010 through 1060 for obtaining a crosstalk removal function with respect to the position recognized in operation 810.

The reading unit 260 reads one or more crosstalk removal functions corresponding to the position recognized in operation 810, from the storage unit 250 in operation 1010.

The inter-aural time difference removal unit 610 removes the inter-aural time difference in each of the crosstalk removal functions read in operation 910, in operation 1020 and the crosstalk removal function interpolation unit 620 interpolates a crosstalk removal function corresponding to the position recognized in operation 810, by using the crosstalk removal functions, in which the inter-aural time differences are removed in operation 810, in operation 1030.

The inter-aural time difference calculation unit 630 obtains an inter-aural time difference that can occur at the position recognized in operation 810, in operation 1040.

The inter-aural time difference generation unit 640 generates the obtained inter-aural time difference in the crosstalk removal function interpolated in operation 1030, and determines the generated result as the crosstalk removal function with respect to the position recognized in operation 810, in operation 1050, and then, operation 840 is performed.

According to the apparatus, method, and medium of removing crosstalk of the present invention as described above, the filter for removing crosstalk in each of the audio signals of the plurality of channels is updated adaptively to the motion of the listener, and thus, even when the listener moves around, the listener is made not to feel crosstalk. Accordingly, the apparatus and method can make the listener always feel the sound source as positioned at an identical place. In this way, the apparatus and method can provide a high quality stereo sound effect to the listener.

Furthermore, according to the present invention, a head related transfer function (or crosstalk removal function) with respect to each of one or more positions is stored in advance, and a head related transfer function (or crosstalk removal function) with respect to a position other than the one or more positions is interpolated using the stored head related transfer functions (or crosstalk removal functions). Accordingly, even when head related transfer functions (or crosstalk removal functions) with respect to only some positions, not all possible positions, are stored in advance, the filter can be updated adaptively to the position of the listener wherever the listener is positioned.

In addition to the above-described exemplary embodiments, exemplary embodiments of the present invention can also be implemented by executing computer readable code/instructions in/on a medium/media, e.g., a computer readable medium/media. The medium/media can correspond to any medium/media permitting the storing and/or transmission of the computer readable code/instructions. The medium/media may also include, alone or in combination with the computer readable code/instructions, data files, data structures, and the like. Examples of code/instructions include both machine code, such as produced by a compiler, and files containing higher level code that may be executed by a computing device and the like using an interpreter. In addition, code/instructions may include functional programs and code segments.

The computer readable code/instructions can be recorded in/on a medium/media in a variety of ways, with examples of the medium/media including magnetic storage media (e.g., floppy disks, hard disks, magnetic tapes, etc.), optical media (e.g., CD-ROMs, DVDs, etc.), magneto-optical media (e.g., floptical disks), and hardware storage devices (e.g., read only memory media, random access memory media, flash memories, etc.). The medium/media may also be a distributed network, so that the computer readable code/instructions are and stored executed in a distributed fashion. The computer readable code/instructions may be executed by one or more processors. The computer readable code/instructions may also be executed and/or embodied in at least one application specific integrated circuit (ASIC) or Field Programmable Gate Array (FPGA).

In addition, one or more software modules or one or more hardware modules may be configured in order to perform the operations of the above-described exemplary embodiments.

The term "module", as used herein, denotes, but is not limited to, a software component, a hardware component, or a combination of a software component and a hardware component, which performs certain tasks. A module may advantageously be configured to reside on the addressable storage medium/media and configured to execute on one or more processors. Thus, a module may include, by way of example, components, such as software components, application specific software component, object-oriented software components, class components and task components, processes, functions, operations, execution threads, attributes, procedures, subroutines, segments of program code, drivers, firmware, microcode, circuitry, data, databases, data structures, tables, arrays, and variables. The functionality provided for in the components or modules may be combined into fewer components or modules or may be further separated into additional components or modules. Further, the components or modules can operate at least one processor (e.g. central processing unit (CPU)) provided in a device. In addition, examples of a hardware components include an application specific integrated circuit (ASIC) and Field Programmable Gate Array (FPGA). As indicated above, a module can also denote a combination of a software component(s) and a hardware component(s). These hardware components may also be considered to be one or more processors.

The computer readable code/instructions and computer readable medium/media may be those specially designed and constructed for the purposes of the present invention, or they may be of the kind well-known and available to those skilled in the art of computer hardware and/or computer software.

Although a few exemplary embodiments of the present invention have been shown and described, it would be appreciated by those skilled in the art that changes may be made in these exemplary embodiments without departing from the principles and spirit of the invention, the scope of which is defined in the claims and their equivalents.

What is claimed is:

1. An apparatus for removing crosstalk in each of audio signals of a plurality of channels, the apparatus comprising:

a position recognizer which recognizes the position of a listener;

a filter update necessity examiner which examines whether or not the recognized position is in an optimum listening region determined according to a current head related transfer function;

a storage unit which stores a head related transfer function with respect to each of one or more positions;

a reading unit which reads one or more head related transfer functions corresponding to the recognized position when the filter update necessity examiner determines that the recognized position is not in an optimum listening region determined according to the current head related transfer function, from the stored head related transfer functions that exist in the storage unit;

a calculator which calculates a crosstalk removal function with respect to the recognized position using the read head related transfer functions; and a filter which removes the crosstalk by using the calculated crosstalk removal function, wherein if one or more head related transfer functions corresponding to the recognized position does not exist in the storage unit, the reading unit reads one or more head related transfer functions with respect to each of a plurality of positions on a straight line on which the recognized position is located, and the calculator calculates the crosstalk removal function with respect to the recognized position by interpolating the read head related transfer functions.

2. The apparatus of claim 1, wherein the filter update necessity examiner comprises examining whether or not the recognized position is in a filter maintaining region set in the optimum listening region.

3. The apparatus of claim 1, wherein the calculator comprises:

an inter-aural time difference remover which removes an inter-aural time difference in each of the read head related transfer functions;

a head related transfer function interpolator which interpolates a head related transfer function with respect to the recognized position, by using the head related transfer function in which the inter-aural time difference is removed;

an inter-aural time difference calculator which calculates an inter-aural time difference that can occur at the recognized position;

an inter-aural time difference generator which generates the calculated inter-aural time difference in the interpolated head related transfer function; and a crosstalk removal function calculator which calculates the crosstalk removal function by using the head related transfer function in which the inter-aural time difference is generated.

4. An apparatus for removing crosstalk in each of audio signals of a plurality of channels, the apparatus comprising:

a position recognizer which recognizes the position of a listener;

a filter update necessity examiner which examines whether or not the recognized position is in an optimum listening region determined according to a current crosstalk removal function;

a storage unit which stores a crosstalk removal function with respect to each of one or more positions;

a reader which reads one or more crosstalk removal functions corresponding to the recognized position when the filter update necessity examiner determines that the recognized position is not in an optimum listening region determined according to the current crosstalk removal functions, from the stored crosstalk removal functions that exist in the storage unit;

a calculator which obtains a crosstalk removal function with respect to the recognized position using the read crosstalk removal functions; and a filter which removes the crosstalk by using the obtained crosstalk removal function, wherein if one or more crosstalk functions corresponding to the recognized position does not exist in the storage unit, the reading unit reads one or more crosstalk removal functions with respect to each of a plurality of positions on a straight line on which the recognized position is located, and the calculator obtains the crosstalk removal function with respect to the recognized position by interpolating the read crosstalk removal function.

5. The apparatus of claim 4, wherein the calculator comprises:

an inter-aural time difference remover which removes an inter-aural time difference in each of the read crosstalk removal functions;

a head related transfer function interpolator which interpolates a crosstalk removal function with respect to the recognized position, by using the crosstalk removal function in which the inter-aural time difference is removed;

an inter-aural time difference calculator which calculates an inter-aural time difference that can occur at the recognized position; and an inter-aural time difference generator which generates the calculated inter-aural time difference in the interpolated crosstalk removal function, and wherein the filter removes the crosstalk by using the crosstalk removal function in which the inter-aural time difference is generated.

6. A method of removing crosstalk in each of audio signals of a plurality of channels, the method comprising:

recognizing the position of a listener;

examining whether or not the recognized position is in an optimum listening region determined according to a current head related transfer function before obtaining the crosstalk removal function;

reading one or more head related transfer functions corresponding to the recognized position when it is determined that the recognized position is not in the optimum listening region determined according to the current head related transfer function, from head related transfer functions prepared in advance that exist in a storage unit;

obtaining a crosstalk removal function with respect to the recognized position by the read head related transfer functions; and removing the crosstalk in each of the audio signals by using the obtained result, wherein if one or more head related transfer functions corresponding to the recognized position does not exist in the storage unit, the reading of one or more head related transfer functions comprises reading one or more head related transfer functions with respect to each of a plurality of positions on a straight line on which the recognized position is located, and the obtaining of the crosstalk removal function comprises obtaining the crosstalk removal function with respect to the recognized position by interpolating the read head related transfer functions.

7. The method of claim 6, wherein the examining comprises:

examining whether or not the recognized position is in a filter maintaining region set in the optimum listening region before obtaining the crosstalk removal function.

8. The method of claim 6, wherein the obtaining of the crosstalk removal function comprises:

removing an inter-aural time difference in each of the read head related transfer functions;

interpolating a head related transfer function with respect to the recognized position, by using the read head related transfer function in which the inter-aural time difference is removed;

obtaining an inter-aural time difference that can occur at the recognized position;

generating the obtained inter-aural time difference in the interpolated head related transfer function; and obtaining the crosstalk removal function by using the head related transfer function in which the inter-aural time difference is generated.

9. A method of removing crosstalk in each of audio signals of a plurality of channels, the method comprising:

recognizing the position of a listener;

examining whether or not the recognized position is in an optimum listening region determined according to a current crosstalk removal function before obtaining the crosstalk removal function;

reading one or more crosstalk removal functions corresponding to the recognized position when it is determined that the recognized position is not in the optimum listening region determined according to the current crosstalk removal function, from crosstalk removal functions prepared in advance that exist in a storage unit;

obtaining a crosstalk removal function with respect to the recognized position by using the read crosstalk removal functions; and removing the crosstalk in each of the audio signals by using the obtained result, wherein if one or more crosstalk functions corresponding to the recognized position does not exist in the storage unit, the reading of one or more head related transfer functions comprises reading one or more crosstalk removal functions with respect to each of a plurality of positions on a straight line on which the recognized position is located, and the obtaining of the crosstalk removal function comprises obtaining the crosstalk removal function with respect to the recognized position by interpolating the read crosstalk removal functions.

10. The method of claim 9, wherein the obtaining of the crosstalk removal function comprises:

removing an inter-aural time difference in each of the read crosstalk removal functions;

interpolating a crosstalk removal function with respect to the recognized position, by using the read crosstalk removal function in which the inter-aural time difference is removed;

obtaining an inter-aural time difference that can occur at the recognized position; and generating the obtained inter-aural time difference in the interpolated crosstalk removal function, and in the removing of the crosstalk by using the obtained result, the crosstalk is removed by using the crosstalk removal function in which the inter-aural time difference is generated.

11. At least one non-transitory computer readable medium storing computer readable instructions that control at least one processor to execute a method of removing crosstalk in each of audio signals of a plurality of channels, wherein the method comprises:

recognizing the position of a listener;

examining whether or not the recognized position is in an optimum listening region determined according to a current head related transfer function before obtaining the crosstalk removal function;

reading one or more head related transfer functions corresponding to the recognized position when it is determined that the recognized position is not in the optimum listening region determined according to the current head related transfer function, from head related transfer functions prepared in advance that exist in a storage unit;

obtaining a crosstalk removal function with respect to the recognized position using the read head related transfer functions; and removing the crosstalk in each of the audio signals by using the obtained result, wherein if one or more head related transfer functions corresponding to the recognized position does not exist in the storage unit, the reading of one or more head related transfer functions comprises reading one or more head related transfer functions with respect to each of a plurality of positions on a straight line on which the recognized position is located, and obtaining of the crosstalk removal function comprises obtaining the crosstalk removal function with respect to the recognized position by interpolating the read head related transfer functions.

12. A method of removing crosstalk in audio signals of a plurality of channels, the method comprising:

recognizing the position of a listener;

examining whether or not the recognized position is in an optimum listening region determined according to a current crosstalk removal function before obtaining the crosstalk removal function;

reading one or more crosstalk removal functions corresponding to the recognized position when it is determined that the recognized position is not in the optimum listening region determined according to the current crosstalk removal function, from crosstalk removal functions prepared in advance that exist in a storage unit;

obtaining a crosstalk removal function with respect to the recognized position by using the read crosstalk removal functions; and removing the crosstalk in the audio signals by using the obtained crosstalk removal function;

wherein if one or more crosstalk functions corresponding to the recognized position does not exist in the storage unit, the reading of one or more crosstalk removal functions comprises reading one or more crosstalk removal functions with respect to each of a plurality of positions on a straight line on which the recognized position is located, and the obtaining of the crosstalk removal function comprises obtaining the crosstalk removal function with respect to the recognized position by interpolating the read crosstalk removal functions.

13. At least one non-transitory computer readable medium storing computer readable instructions that control at least one processor to implement the method of claim 12.

* * * * *